US006192845B1

(12) United States Patent
Guzak

(10) Patent No.: US 6,192,845 B1
(45) Date of Patent: Feb. 27, 2001

(54) HYDRAULIC LASH ADJUSTER

(75) Inventor: Michael J. Guzak, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/470,713

(22) Filed: Dec. 22, 1999

(51) Int. Cl.[7] ..... F01L 1/24; F01L 1/16

(52) U.S. Cl. ..... 123/90.43; 123/90.35; 123/90.36; 123/90.46; 123/90.55

(58) Field of Search ..... 123/90.35, 90.36, 123/90.43, 90.45, 90.46, 90.55, 90.57, 90.59

(56) References Cited

U.S. PATENT DOCUMENTS 4,228,771 * 10/1980 Krieg ..... 123/90.55
4,788,947 * 12/1988 Edelmayer ..... 123/90.55
5,311,845 * 5/1994 Takahashi ..... 123/90.43
5,622,147 4/1997 Edelmayer ..... 123/90.35
5,623,898 * 4/1997 Bruton ..... 123/90.35
5,901,676 * 5/1999 Edelmayer ..... 123/90.35

* cited by examiner

*Primary Examiner*—Weilun Lo
(74) *Attorney, Agent, or Firm*—L. J. Kasper

(57) ABSTRACT

A hydraulic lash adjuster (1) having a plunger assembly (3) including an upper plunger (4) and a lower plunger (5), the plungers being disposed within a body (2) defining a bore (2*b*,7), and in conventional leakdown plungers, cooperating with the bore to define a nominal diametral clearance. In accordance with one aspect of the invention, the plungers and the bore are provided with a reduced diametral clearance, substantially less than the nominal clearance, thus substantially improving the consistency of leakdown times. In accordance with another aspect of the invention, the upper plunger element (4) includes a center land (25) which defines a fluid passage (33), such as by having a flat (31) ground into the land, to insure the proper amount of lubrication fluid flowing out of the ball plunger (20).

3 Claims, 3 Drawing Sheets

HYDRAULIC LASH ADJUSTER

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates generally to hydraulic lash adjusters, and more particularly to a hydraulic lash adjuster (HLA) of the type in which there is both a high pressure chamber and a reservoir, or low pressure chamber.

Hydraulic lash adjusters (also sometimes referred to as "lifters") for internal combustion engines have been in use for many years to eliminate clearance, or lash, between engine valve train components under varying operating conditions, in order to maintain efficiency and to reduce noise and wear in the valve train. Hydraulic lash adjusters operate on the principle of transmitting the energy of the valve actuating cam through hydraulic fluid, trapped in a pressure chamber under a plunger. During each operation of the cam, as the length of the valve actuating components varies as a result of temperature changes and wear, small quantities of hydraulic fluid are permitted to enter the pressure chamber, or escape therefrom, thus effecting an adjustment in the position of the plunger, and consequently adjusting the effective total length of the valve train.

The cam operating cycle comprises two distinct events: (1) operation on the base circle and (2) valve actuation. The base circle event is characterized by a constant radius between the cam center of rotation and the cam follower, and during this event, no cam energy is transmitted. The valve actuation event is characterized by a varying radius between the cam center of rotation and the cam follower, which effectively transmits cam energy to open and close an engine valve. During the valve actuation event, a portion of the load resulting from the valve spring, the inertia of valve train components, and cylinder pressure are transmitted through the valve train and through the lash adjuster. The load increases the pressure of the hydraulic fluid within the lash adjuster pressure chamber, in proportion to the plunger area, and in typical hydraulic lash adjusters currently in commercial production, fluid escapes the pressure chamber between the plunger and the wall of the lash adjuster body. Such a device is referred to as a "conventional leakdown" lash adjuster. Although the present invention could be utilized in various types of hydraulic lash adjusters, it is especially adapted for use in an HLA of the conventional leakdown type, and will be described in connection therewith.

As noted previously, commercial HLA's of the conventional leakdown type have controlled the escape of fluid (or "leakdown") from the high pressure chamber solely by the fit of the plunger within the body, thus necessitating fairly close clearances therebetween. For example, it is common practice in the HLA art to centerless grind the outer surface of the plungers, and then select fit the plungers within the body bores to achieve a diametral clearance in the range of about 0.002 inches (0.0508 mm), which is considered a typical, nominal diametral clearance for a conventional leakdown type device.

There has recently been an increasing demand by vehicle manufacturers for an HLA having a relatively faster leakdown. Those skilled in the engine valve train art will understand that as the engine is warming up rapidly from very low temperatures, a conventional HLA may not be able to compensate quickly enough for the temperature-related growth in the length of the valve train components (especially, the exhaust valve). When such rapid growth occurs, and the HLA is unable to compensate quickly enough, the result is that the valve may remain open on the base circle which is generally recognized as being extremely undesirable.

One of the performance requirements for hydraulic lash adjusters is the ability to communicate lubricating fluid through the lash adjuster and out the ball plunger, to provide appropriate lubrication to an adjacent surface of a valve train component, such as the rocker arm. Specifically, it is important that the HLA be able to provide a fairly constant and consistent flow of lubrication fluid, without allowing air to be drawn through the meter passage in the ball plunger, and into the reservoir. An HLA having excellent lubrication metering capability is illustrated and described in U.S. Pat. No. 5,855,191, assigned to the assignee of the present invention and incorporated herein by reference. In the incorporated patent, there is provided a metering valve which defines a metering passage capable of communicating a small, controlled metering flow from the reservoir of the HLA to the external surface of the ball plunger. Unfortunately, there are now a number of engine applications in which the HLA is oriented generally horizontally, rather than vertically, thus limiting the ability to use the lubricant metering approach in the above-cited patent.

BRIEF SUMMARY OF THE INVENTION

Accordingly, it is an object of the present invention to provide an improved hydraulic lash adjuster of the type which is able to achieve relatively faster leakdown.

It is another object of the present invention to provide an improved hydraulic lash adjuster which is able to achieve the above-stated object, and is also able to achieve good lubricant metering, even when the HLA is oriented generally horizontally.

It is a further object of the present invention to provide an improved HLA which achieves the above objects, but without the need for substantial redesign of the HLA, and especially without redesign of the type which would obsolete a substantial amount of the existing manufacturing process and equipment.

The above and other objects of the invention are accomplished by the provision of a hydraulic lash adjuster for an internal combustion engine, the lash adjuster comprising a body defining a blind first bore therein, and a fluid port in communication with a source of fluid pressure. A plunger assembly is slidingly received within the blind bore, the plunger assembly and the blind bore cooperating to define a pressure chamber and a fluid chamber disposed within the plunger assembly. A biasing means normally urges the plunger assembly outward of the blind bore. The plunger assembly includes an upper plunger element having a ball plunger element adapted for engagement with an adjacent surface of a valve train component, and a lower plunger element. The blind bore and the lower plunger element cooperate to define a leakdown clearance providing fluid communication between the pressure chamber and the fluid chamber. The upper plunger element includes top, center, and bottom lands cooperating with the blind bore to define a nominal diametral clearance. The ball plunger element defines a fluid meter passage adapted to communicate fluid to the adjacent surface of a valve train component, the upper plunger element defining a fluid passage providing communication from a region between the center and top lands to the fluid meter passage.

The improved hydraulic lash adjuster is characterized by the top, center, and bottom lands cooperating with the blind bore to define a reduced diametral clearance, substantially less than the nominal diametral clearance. The center land defines a fluid passage means having a predetermined flow area, the flow area being selected to provide a desired metering flow through the fluid meter passage.

DETAILED DESCRIPTION OF THE PREFERRED EMBODIMENT

Figure 1:
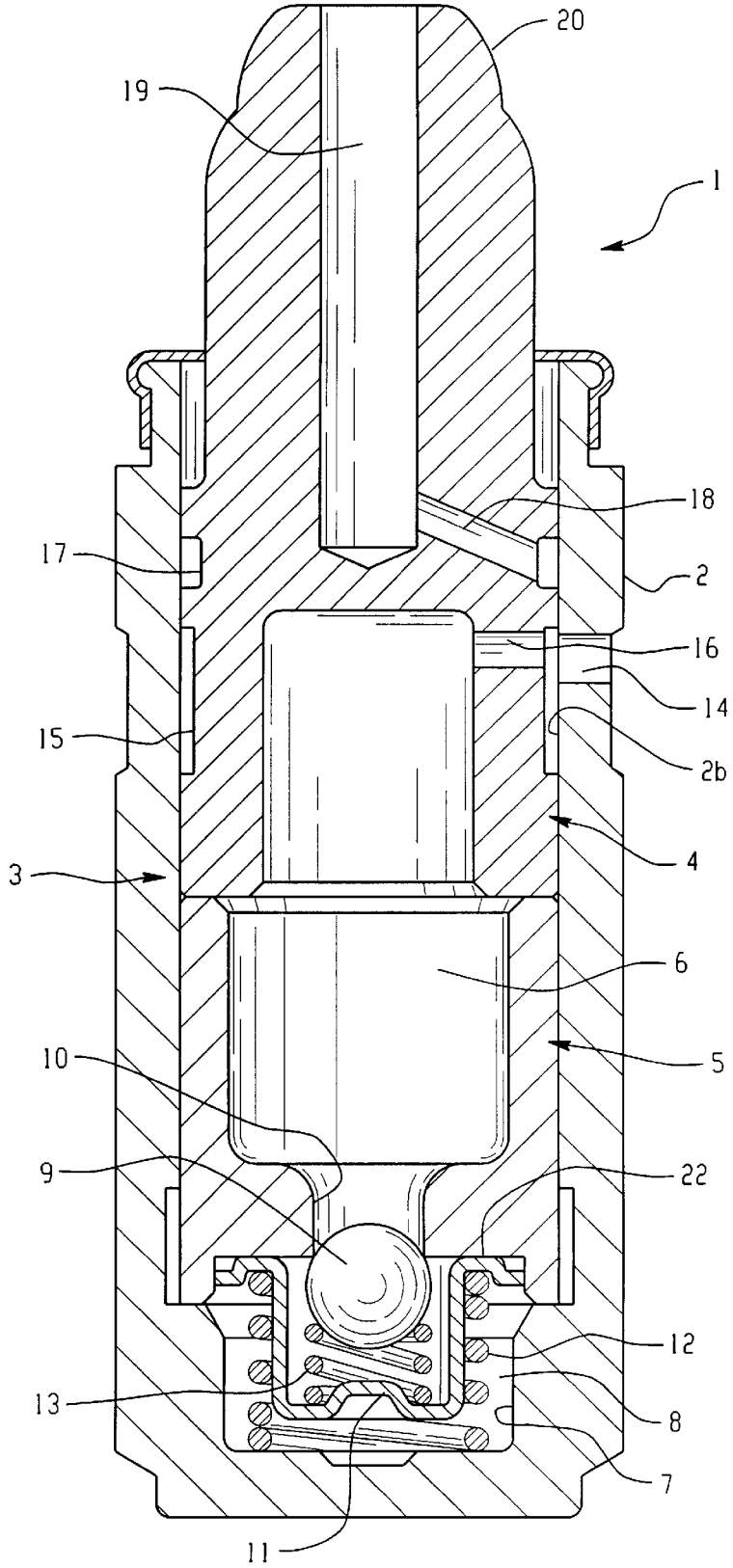
Fig. 1 PRIOR ART
FIG. 1 is a cross-sectional view of a conventional ("Prior Art") hydraulic lash adjuster of the type with which the present invention may be utilized.

Referring now to the drawings, which are not intended to limit the invention, FIG. 1 illustrates a prior art hydraulic lash adjuster 1 having a body 2, and a plunger assembly, generally designated 3, which is slidingly disposed within the body 2. The plunger assembly 3 includes an upper plunger element 4 and a lower plunger element 5. The plunger elements 4 and 5 are received within the body in a close fitting relationship within a bore 2*b* of the body 2, as was described in some detail in the BACKGROUND OF THE DISCLOSURE. The upper and lower plunger elements 4 and 5 define a low pressure chamber (reservoir) 6 between them. The bottom of the lower plunger element 5 forms, in cooperation with the end of a reduced diameter portion 7 of the body bore 2*b*, a high pressure chamber 8. A check valve 9 is disposed in the end of a passage 10 which connects the high pressure chamber 8 and the low pressure chamber 6.

The check valve 9, which is shown as a ball by way of example only, but which can also be a flat disk or the like, is retained by a cage 11 which is in an interference fit within a counterbore 22 formed in the lower plunger element 5. Thus, the cage 11 provides a seat for a lash adjuster plunger spring 12. In accordance with the common design practice, there is shown in FIG. 1 a bias spring 13, acting between the bottom of the cage 11 and the check ball 9, biasing the check ball into a normally closed position. However, various other check ball biasing arrangements are known, and it should be understood that the present invention is not limited to any particular check valve configuration or arrangement for biasing the check valve. Furthermore, the check valve could be positioned to be "free" and not be biased in any direction.

An oil entry port 14 opens into the bore 2*b* of the body 2 and intersects a collector groove 15 which, in turn, intersects a radial port 16 in the upper plunger element 4, to supply hydraulic fluid from a source (not shown herein) to the low pressure chamber 6. A second collector groove 17 and a port (or passage) 18 in the upper plunger element 4 provide metered hydraulic fluid to an axial meter passage 19, to supply lubricant to an adjacent surface of a rocker arm (not shown). Typically, the surface of the rocker arm would engage a ball plunger element 20 formed on the upper end of the upper plunger element 4.

Figure 2:
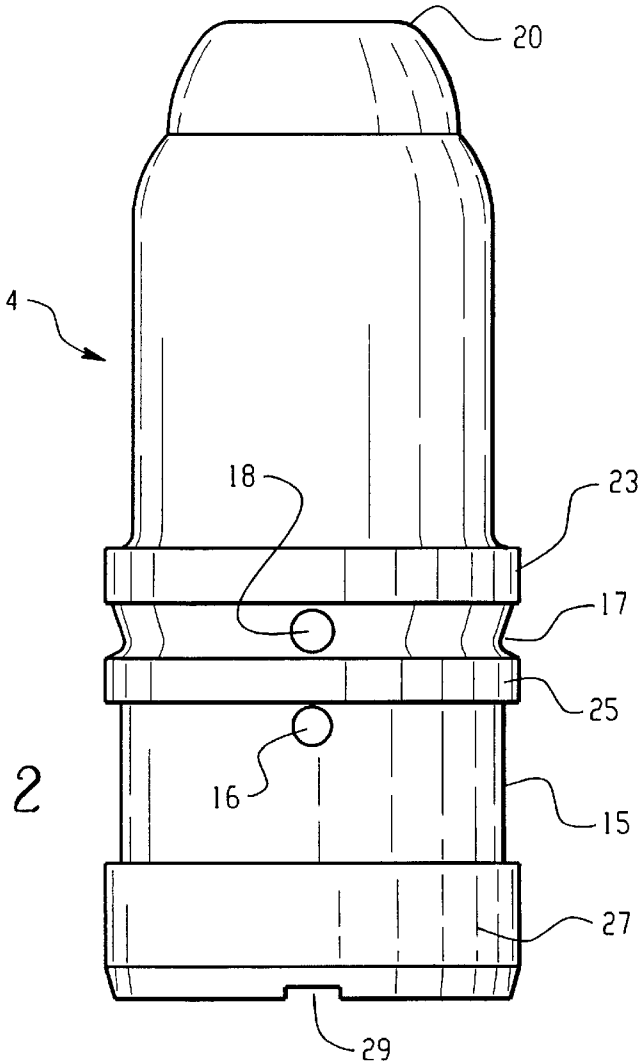
FIG. 2 is an external plan view of an upper plunger element made in accordance with the present invention, on approximately the same scale as FIG. 1.

As is already generally known in the art, metering of lubricant through the fluid meter passage 19 is controlled by means of a controlled clearance between the upper plunger element 4 and the bore 2*b* of the body 2. Referring now to FIG. 2, in conjunction with FIG. 1, the upper plunger element 4 of the type to which this invention relates includes a top land 23, a center land 25, and a bottom land 27. As was discussed in the BACKGROUND OF THE DISCLOSURE, in the conventional prior art HLA, it would be common practice to grind all three of the lands 23, 25 and 27 to substantially the same diameter. Subsequently, the particular upper plunger element 4 would have been select fit within a body 2 such that the diametral clearance between each land 23, 25, and 27 and the bore 2*b* would have been in the range of about 0.002 inches (0.0508 mm). This is the typical, nominal (prior art) diametral clearance for an HLA of this type.

In accordance with one important aspect of the present invention, each of the lands 23, 25 and 27 would again be ground to substantially the same diameter (i.e., "substantially" meaning within reasonable, commercially available grinding capabilities), but then the upper plunger element 4 is select fit with a particular body 2 such that the diametral clearance between each of the lands and the bore 2*b* is in the range of about 0.0005 inches (0.0127 mm) to about 0.0010 inches (0.0254 mm). For purposes of the present invention, the diametral clearance range referred to above constitutes the definition of a "reduced diametral clearance", being substantially less than the "nominal" diametral clearance or conventional, prior art diametral clearance discussed previously.

It has been found in connection with the development of the present invention that one of the impediments to a rapid leakdown in a conventional HLA is inconsistency in the rate of leakdown once the entire HLA is assembled, including the upper plunger element 4. Furthermore, it has been determined that one of the primary factors in inconsistent rates of leakdown is the prior art ability for the upper plunger element to "cock" (become non-axial) within the bore 2*b* of the body. In connection with the development of the present invention, it has been determined that the use of the reduced diametral clearance between the lands of the upper plunger element 4 and the bore 2*b* substantially eliminates the cocking of the upper plunger element within the bore. It has also been determined that, unexpectedly, eliminating the cocking of the upper plunger element within the bore substantially improve the consistency of measured leakdown times. One of the performance requirements increasingly being sought by customers for hydraulic lash adjusters is greater consistency in actual, measurable leakdown times.

During operation, with conventional leakdown occurring, fluid is communicated from the high pressure chamber 8 through the diametral clearance between the lower plunger element 5 and the bore 2*b*, and then the leakdown fluid flows radially inward into the low pressure chamber 6. As may best be seen in FIG. 2, the communication of the leakdown fluid into the low pressure chamber 6 may be accomplished through one or more notches 29, in accordance with the teachings of U.S. Pat. No. 5,862,785, assigned to the assignee of the present invention and incorporated herein by reference.

Figure 3:
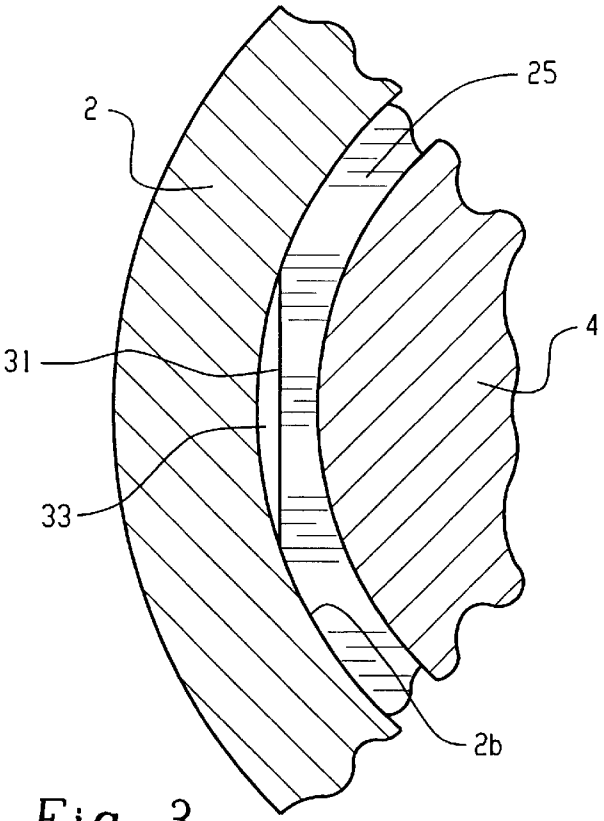
FIG. 3 is a greatly enlarged, fragmentary, transverse cross-section illustrating one aspect of the present invention.

Referring now primarily to FIG. 3, another important aspect of the present invention will be described. FIG. 3 is a greatly enlarged, fragmentary, transverse cross-section, with the upper plunger element 4 assembled within a body 2, looking down on the top of the center land 25 (i.e., in a downward direction in FIG. 1). In accordance with the invention, the center land 25 has the reduced diametral clearance described previously, but in addition, defines, by way of example only, a flat 31 which extends over the entire axial length of the center land 25. Thus, the flat 31 and the bore 2*b* of the body cooperate to define a fluid passage 33 which permits fluid entering the oil entry port 14 to flow, in a known, measured quantity, past the center land 25 into the second collector groove 17. From the groove 17, the measured quantity of lubrication fluid flows through the port 18 into the axial meter passage 19, and from there to the exterior surface of the ball plunger element 20, thus lubricating the adjacent surface of whatever valve train component engages the ball plunger element 20.

Those skilled in the art of hydraulic lash adjusters, and particularly those skilled in the art of manufacturing lash adjuster components will understand that the flat 31 has been selected as the preferred embodiment of this aspect of the present invention primarily for ease of processing. Grinding the flat 31 on the center land 25 requires relatively little capital equipment, can be done quickly and cheaply, and does not require any particular rotational orientation of the upper plunger element 4 while the flat 31 is being formed. However, those skilled in the art will also understand that any number of other fluid passage configurations could be used, within the scope of the present invention, recognizing that the flow area created by the flat 31 is typically smaller than could readily be formed by drilling a hole through the land, or through the element 4, connecting the low pressure chamber 6 directly with the axial meter passage 19.

Figure 4:
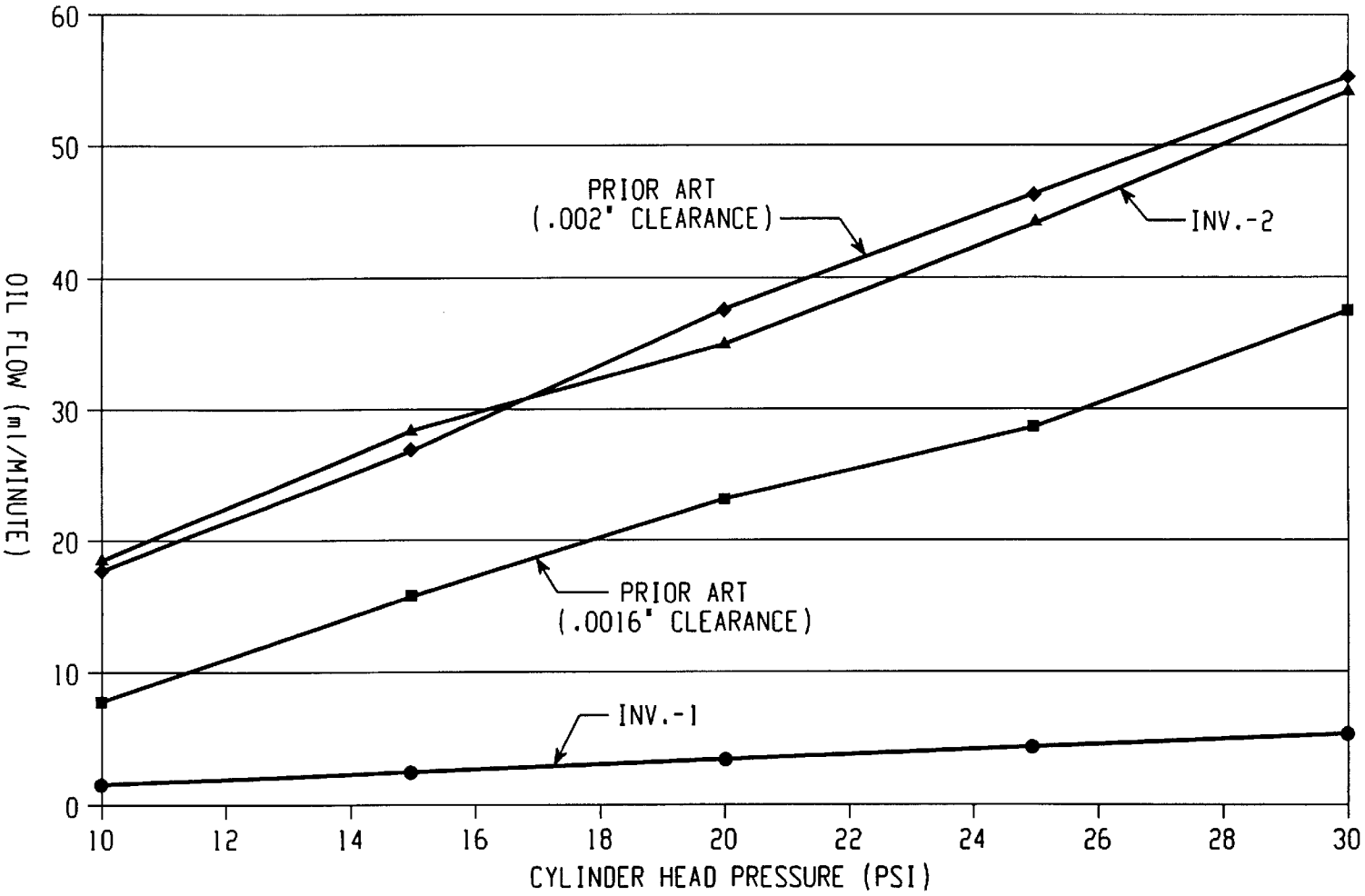
FIG. 4 is a graph of lubricating oil flow versus cylinder head pressure, illustrating one aspect of the present invention.

It is quite often the case that the vehicle manufacturer who is the customer for the HLA specifies a particular flow rate of lubricant which must flow out of the axial meter passage 19. Thus, in practicing the present invention, it is believed to be within the ability of those skilled in the art to determine, experimentally, the depth (in the radial direction) of the flat 31 which would provide the desired lubricant flow rate out of the HLA. Referring now to FIG. 4, there is a graph which was generated in connection with the development of the subject embodiment of the invention. The graph of FIG. 4 is a graph of Oil Flow (i.e., the lubrication flow out of the meter passage 19) as a function of cylinder head pressure (i.e., fluid pressure available at port 14).

The 2 curves labeled "Prior Art" in FIG. 4 represent a conventional leakdown clearance HLA having the typical, nominal diametral clearance. Assuming then that the "Prior Art" oil flow provides the amount of lubrication being requested by the engine manufacturer, the practice of the present invention requires the use of the reduced diametral clearance, but accompanied by a flat 31 of such dimensions as to result in a passage 33 which provides the desired flow. By way of example only, in an HLA with a reduced diametral clearance of 0.0005 inches, and a flat with a depth of 0.0015 inches (labeled "INV. –1"), the lubrication flow was from about 2 to about 6 ml/minute, which would typically be inadequate for most engine applications. However, in another HLA, with a reduced diametral clearance of 0.001 inches, and a flat with a depth of 0.0035 inches (labeled "INV. –2"), the lubrication flow closely tracked that which occurred with a 0.002 inch nominal clearance, which would typically be very satisfactory.

Thus, it may be seen that the present invention provides an improved HLA which is capable of substantially improved consistency of leakdown times, while at the same time, providing whatever lubrication flow is required, and doing so regardless of the installation orientation of the HLA.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A hydraulic lash adjuster for an internal combustion engine, said lash adjuster comprising a body defining a blind first bore therein, and a fluid port in communication with a source of fluid pressure; a plunger assembly slidingly received within said blind first bore, said plunger assembly and said blind first bore cooperating to define a pressure chamber, and a fluid chamber disposed within said plunger assembly; biasing means normally urging said plunger assembly outward of said blind first bore; said plunger assembly including an upper plunger element having a ball plunger element adapted for engagement with an adjacent surface of a valve train component, and a lower plunger element, said blind first bore and said lower plunger element cooperating to define a leakdown clearance providing fluid communication between said pressure chamber and said fluid chamber; said upper plunger element including top, center, and bottom lands cooperating with said blind first bore to define a nominal diametral clearance, said ball plunger element defining a fluid meter passage adapted to communicate fluid to said adjacent surface of a valve train component, said upper plunger element defining a fluid passage providing fluid communication from a region between said center and top lands to said fluid meter passage; characterized by:

(a) said top, center, and bottom lands cooperating with said blind first bore to define a reduced diametral clearance, substantially less than said nominal diametral clearance; and (b) said center land defining fluid passage means having a predetermined flow area, said flow area being selected to provide a desired metering flow through said fluid meter passage.

2. A hydraulic lash adjuster as claimed in claim 1, characterized by said nominal diametral clearance being in the range of about 0.0020 inches (0.0508 mm), and said reduced diametral clearance being in the range of about 0.0005 inches (0.0127 mm) to about 0.0010 inches (0.0254 mm).

3. A hydraulic lash adjuster as claimed in claim 1, characterized by said fluid passage means comprising a flat machined on said center land, said flat cooperating with said blind first bore to define said flow area.

* * * * *